US009458598B2

(12) United States Patent
Takaura et al.

(10) Patent No.: US 9,458,598 B2
(45) Date of Patent: Oct. 4, 2016

(54) WORK VEHICLE

(71) Applicant: KOMATSU LTD., Tokyo (JP)

(72) Inventors: Takeshi Takaura, Minoh (JP); Yoshiki Kami, Hadano (JP); Jin Kitajima, Ohiso-machi (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/372,472

(22) PCT Filed: Apr. 24, 2014

(86) PCT No.: PCT/JP2014/061538
§ 371 (c)(1),
(2) Date: Jul. 16, 2014

(87) PCT Pub. No.: WO2014/192474
PCT Pub. Date: Dec. 4, 2014

(65) Prior Publication Data

US 2015/0308081 A1 Oct. 29, 2015

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/26*** | (2006.01) |

(52) U.S. Cl.
CPC ..... *E02F 3/439* (2013.01); *E02F 3/32* (2013.01); *E02F 3/437* (2013.01); *E02F 9/2033* (2013.01); *E02F 9/262* (2013.01); *E02F 9/265* (2013.01)

(58) Field of Classification Search
CPC ..... E02F 9/262; E02F 3/32; E02F 3/439; E02F 9/2033; E02F 9/265
See application file for complete search history.

(56) References Cited

U.S. PATENT DOCUMENTS 3,576,268 A * 4/1971 Suverkrop ..... E02F 3/437 414/694
5,446,980 A * 9/1995 Rocke ..... E02F 3/439 701/50

(Continued)

FOREIGN PATENT DOCUMENTS

CN 102561445 A 7/2012
JP H08-134949 A 5/1996

(Continued)

*Primary Examiner* — Dale W Hilgendorf
(74) *Attorney, Agent, or Firm* — Drinker Biddle & Reath LLP

(57) ABSTRACT

There is provided a work vehicle in which sudden operation of a work implement can be suppressed. The work vehicle includes a design surface information acquiring unit for acquiring data of a design surface indicative of a target shape of a work object by the work implement; a cutting edge position computing unit for computing a position of a cutting edge of a bucket; and an operation restricting unit for executing operation restriction control by which a boom is forcibly raised in accordance with a relative position of the cutting edge to the design surface, and the position of the cutting edge is restricted to an upper part of the design surface. In a state where the cutting edge is located away from the design surface in a downward perpendicular direction by a prescribed distance or longer, the operation restricting unit does not execute the operation restriction control.

13 Claims, 8 Drawing Sheets

(56) References Cited

U.S. PATENT DOCUMENTS 5,701,691 A * 12/1997 Watanabe ..... E02F 3/435 701/50
5,735,065 A * 4/1998 Yamagata ..... E02F 3/437 701/50
5,822,891 A * 10/1998 Fujishima ..... E02F 9/2033 701/50
5,835,874 A * 11/1998 Hirata ..... E02F 3/435 701/50
5,960,378 A * 9/1999 Watanabe ..... E02F 3/437 37/415
6,076,029 A * 6/2000 Watanabe ..... E02F 3/437 701/50
6,131,061 A * 10/2000 DenBraber ..... E02F 3/435 701/50
6,209,232 B1 * 4/2001 Ono ..... E02F 3/435 701/50
6,275,757 B1 * 8/2001 Watanabe ..... E02F 3/437 172/6
6,336,077 B1 * 1/2002 Boucher ..... E02F 3/435 37/348
6,782,644 B2 * 8/2004 Fujishima ..... E02F 3/435 340/679
7,457,698 B2 * 11/2008 Danko ..... E02F 3/439 414/1
7,949,449 B2 * 5/2011 Koch ..... E02F 3/437 37/414
8,903,604 B2 * 12/2014 Fukano ..... E02F 9/264 432/1
8,914,199 B2 * 12/2014 Nomura ..... E02F 3/32 340/995.27
8,965,642 B2 * 2/2015 Johnson ..... E02F 3/32 701/50
2006/0026101 A1 * 2/2006 Ogura ..... E02F 9/26 705/50
2012/0136508 A1 * 5/2012 Taylor ..... E02F 9/262 701/2
2013/0158784 A1 * 6/2013 Fukano ..... E02F 9/262 701/34.4
2013/0158787 A1 * 6/2013 Nomura ..... E02F 9/26 701/34.4
2013/0302124 A1 * 11/2013 Matsuyama ..... E02F 3/435 414/687
2013/0311031 A1 * 11/2013 Friend ..... E02F 9/262 701/26
2013/0315699 A1 * 11/2013 Matsuyama ..... E02F 3/435 414/687
2014/0100712 A1 * 4/2014 Nomura ..... E02F 3/32 701/1
2014/0142817 A1 * 5/2014 Matsuyama ..... E02F 3/439 701/50

FOREIGN PATENT DOCUMENTS

JP 2001-032331 A 2/2001
JP 2001-227001 A 8/2001
JP 2008-216143 A 9/2008
JP 2009-179968 A 8/2009
JP 2013-217137 A 10/2013
WO WO 95/30059 A 11/1995

* cited by examiner

WORK VEHICLE

TECHNICAL FIELD

The present invention relates to a work vehicle.

BACKGROUND ART in conventional work vehicles, there is a technique of restricting an operating range of a front work device to a prescribed area provided in advance. For example, PTD 1 discloses a control device for restricting an operating range of a front work device to a prescribed area, wherein the operation restriction on the front work device is lifted when the operation of at least one of an undercarriage and an upper revolving unit is detected.

CITATION LIST

Patent Document

PTD 1: Japanese Patent Laying-Open No. 2001-32331

SUMMARY OF INVENTION

Technical Problem

A work vehicle that acquires design surface information from the outside, detects a position of a work implement and automatically controls the work implement based on the detected position of the work implement is also being developed.

In the case of automatically controlling the work implement in a land leveling work with a hydraulic excavator, control for raising a boom automatically and forcibly is executed when it is expected that a cutting edge of a bucket will become lower than a design surface, in order to avoid deeper excavation than the design surface.

In an embankment work when developing a land or a road, an upper surface of an embankment serves as a design surface in an area that will be subjected to the embankment work (area scheduled for embankment). Therefore, if the aforementioned automatic control for forcibly raising the boom is executed during the embankment work, the boom suddenly operates when the bucket enters the area scheduled for embankment.

An object of the present invention is to provide a technique that can suppress occurrence of sudden operation of a work implement.

Solution to Problem

A work vehicle according to the present invention includes: a work implement; a design surface information acquiring unit; a cutting edge position computing unit; and an operation restricting unit. The work implement has a boom, an arm attached to a distal end of the boom, and a bucket attached to a distal end of the arm. The design surface information acquiring unit acquires data of a design surface indicative of a target shape of a work object by the work implement. The cutting edge position computing unit computes a position of a cutting edge of the bucket. The operation restricting unit executes operation restriction control. The operation restriction control is control by which the boom is forcibly raised in accordance with a relative position between the position of the cutting edge of the bucket and the design surface, and the position of the cutting edge is restricted to an upper part of the design surface. In a state where the cutting edge is located away from the design surface in a downward perpendicular direction by a prescribed distance or longer, the operation restricting unit executes control so as not to execute the operation restriction control.

According to the work vehicle of the present invention, sudden operation of the boom in the state where the cutting edge is located away from the design surface in the downward perpendicular direction by the prescribed distance or longer can be prevented.

In the work vehicle, when the design surface is a slope inclined by a prescribed angle or larger with respect to a horizontal direction, the operation restricting unit executes control so as not to execute the operation restriction control. Thus, sudden operation of the boom when the design surface is a steep slope can be prevented.

In the work vehicle, the operation restricting unit controls the boom to prevent the position of the cutting edge from becoming lower than the design surface. Thus, the land leveling work can be performed in accordance with the design surface, and therefore, the quality and efficiency of the land leveling work with the hydraulic excavator can be enhanced.

In the work vehicle, when the position of the cutting edge becomes lower than the design surface, the operation restricting unit forcibly raises the boom. Thus, the land leveling work can be performed in accordance with the design surface, and therefore, the quality and efficiency of the land leveling work with the hydraulic excavator can be enhanced.

The work vehicle transmits and receives information to and from the outside by satellite communication. Thus, the construction based on the information transmitted and received to and from the outside becomes possible, and the highly-efficient and highly-accurate land leveling work with the work vehicle can be realized.

Advantageous Effects of Invention

As described above, according to the present invention, the occurrence of sudden operation of the work implement can be suppressed.

DESCRIPTION OF EMBODIMENTS

An embodiment of the present invention will be described hereinafter with reference to the drawings.

First, a configuration of a hydraulic excavator as one example of a work vehicle to which a technical idea of the present invention is applicable will be described.

Figure 1:
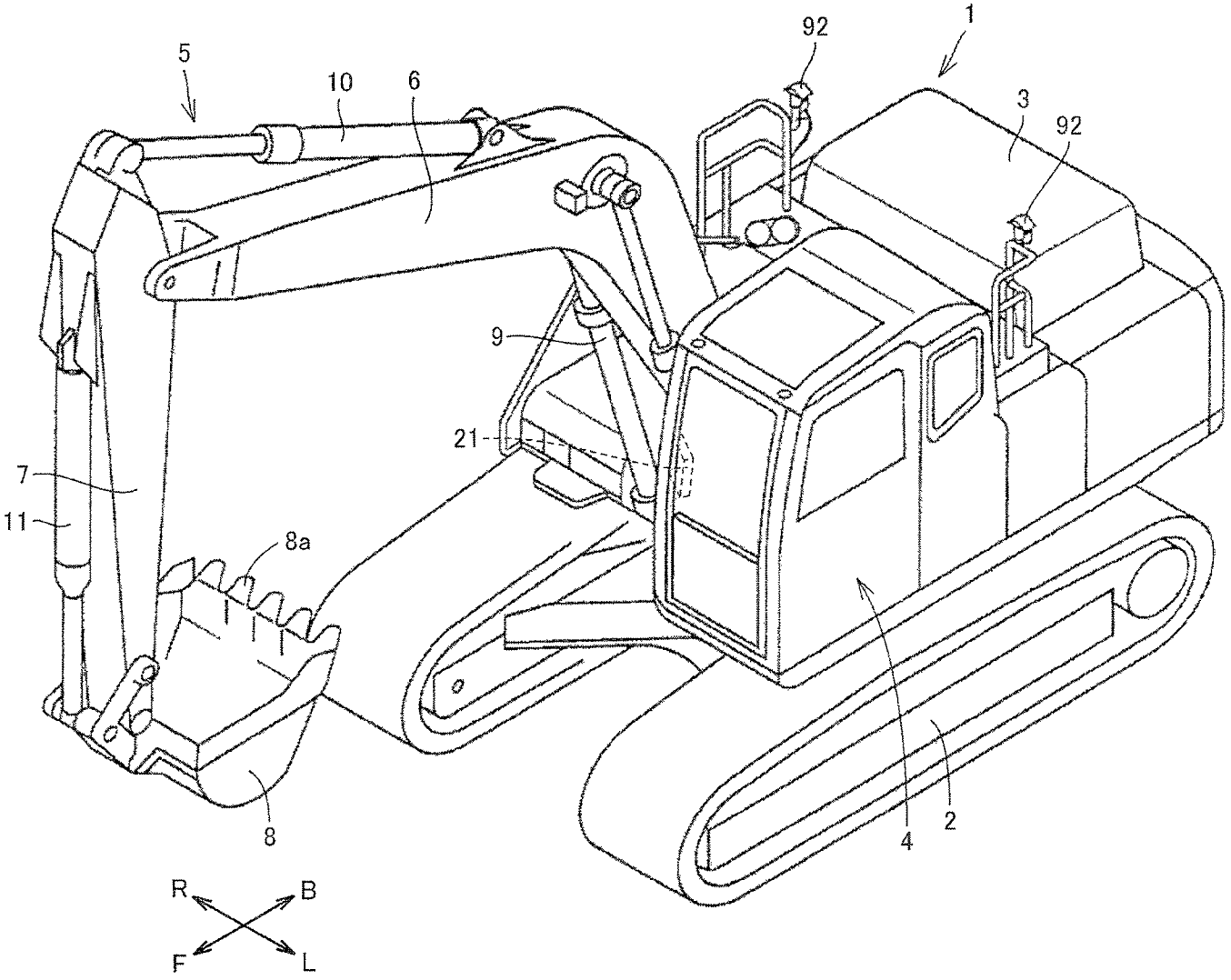
FIG. 1 is a schematic perspective view showing a configuration of a hydraulic excavator according to one embodiment of the present invention.

FIG. 1 is a schematic perspective view showing a configuration of a hydraulic excavator 1 according to one embodiment of the present invention. As shown in FIG. 1, hydraulic excavator 1 mainly includes an undercarriage 2, an upper revolving unit 3 and a work implement 5. Undercarriage 2 and upper revolving unit 3 constitute a work vehicle main body.

Undercarriage 2 has a pair of left and right crawler belts. It is configured to allow hydraulic excavator 1 to be self-propelled by rotation of the pair of crawler belts. Upper revolving unit 3 is disposed to be pivotable with respect to undercarriage 2.

Upper revolving unit 3 includes a cab 4 that is a space for an operator to operate hydraulic excavator 1. Cab 4 is included in the work vehicle main body. On the backward side B, upper revolving unit 3 includes an engine compartment that houses an engine, and a counter weight. In the present embodiment, the frontward side (front side) of the operator when seated in cab 4 will be referred to as frontward side F of upper revolving unit 3, and the side opposite to frontward side F, i.e., the backward side of the operator will be referred to as backward side B of upper revolving unit 3. The left side of the operator when seated will be referred to as left side L of upper revolving unit 3, and the right side of the operator when seated will be referred to as right side R of upper revolving unit 3. In the following description, it is assumed that the frontward-backward and left-right directions of upper revolving unit 3 match the frontward-backward and left-right directions of hydraulic excavator 1.

Work implement 5 that performs works such as soil excavation is pivotably supported by upper revolving unit 3 so as to be operable in the upward-downward direction. Work implement 5 has a boom 6 attached to a substantially central portion on frontward side F of upper revolving unit 3 so as to be operable in the upward-downward direction, an arm 7 attached to a distal end of boom 6 so as to be operable in the backward-frontward direction, and a bucket 8 attached to a distal end of arm 7 so as to be operable in the backward-frontward direction. Bucket 8 has a cutting edge 8*a* at a tip thereof. Boom 6, arm 7 and bucket 8 are configured to be driven by a boom cylinder 9, an arm cylinder 10 and a bucket cylinder 11 that are hydraulic cylinders, respectively.

Cab 4 is arranged on frontward side F and on left side L of upper revolving unit 3. With respect to cab 4, work implement 5 is provided on right side R that is one side portion side of cab 4. It should be noted that the arrangement of cab 4 and work implement 5 is not limited to the example shown in FIG. 1, and work implement 5 may be provided, for example, on the left side of cab 4 arranged on the frontward right side of upper revolving unit 3.

Figure 2:
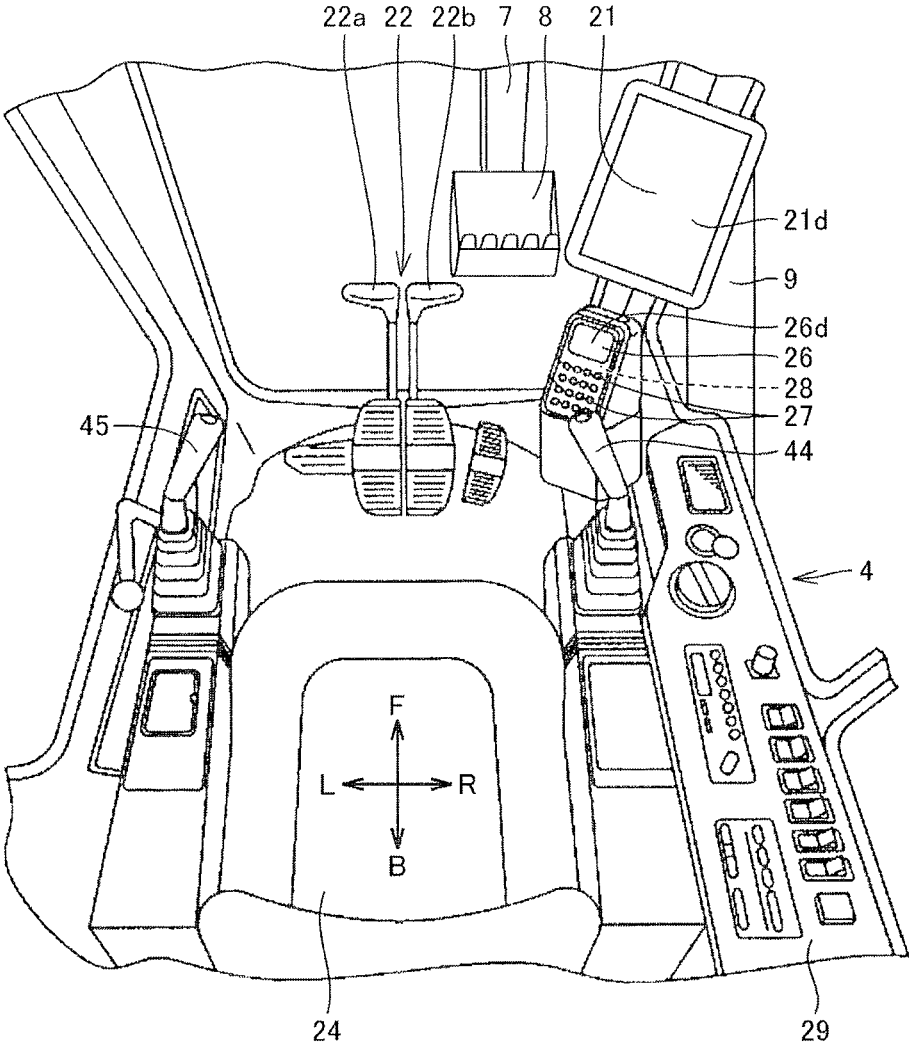
FIG. 2 is a perspective view of the inside of a cab of the hydraulic excavator.

FIG. 2 is a perspective view of the inside of cab 4 of hydraulic excavator 1. As shown in FIG. 2, an operator's seat 24 on which the operator facing toward frontward side F is seated is arranged inside cab 4. Cab 4 includes a roof portion arranged to cover operator's seat 24, and a plurality of pillars supporting the roof portion. The plurality of pillars have a front pillar arranged on frontward side F with respect to operator's seat 24, a rear pillar arranged on backward side B with respect to operator's seat 24, and an intermediate pillar arranged between the front pillar and the rear pillar. Each pillar extends along a perpendicular direction orthogonal to a horizontal surface, and is coupled to a floor portion and the roof portion of cab 4.

A space surrounded by each pillar and the floor and roof portions of cab 4 forms an interior space of cab 4. Operator's seat 24 is housed in the interior space of cab 4 and is arranged at a substantially center of the floor portion of cab 4. A side surface on left side L of cab 4 is provided with a door for the operator to get in or out of cab 4.

A front window is arranged on frontward side F with respect to operator's seat 24. The front window is made of a transparent material and the operator seated on operator's seat 24 can view the outside of cab 4 through the front window. For example, as shown in FIG. 2, the operator seated on operator's seat 24 can directly view bucket 8 excavating soil through the front window.

A monitor device 26 is disposed on frontward side F inside cab 4. Monitor device 26 is arranged at a corner on the frontward right side inside cab 4, and is supported by a support extending from the floor portion of cab 4. Monitor device 26 is arranged on the operator's seat 24 side with respect to the front pillar. Monitor device 26 is arranged in front of the front pillar when viewed from the operator seated on operator's seat 24.

For multipurpose use, monitor device 26 includes a planar display surface 26*d* having various monitor functions, a switch unit 27 having a plurality of switches to which many functions are assigned, and a sound generator 28 that expresses by sound the contents displayed on display surface 26*d* . This display surface 26*d* is configured by a graphic indicator such as a liquid crystal indicator and an organic EL (electroluminescent) indicator. Although switch unit 27 includes a plurality of key switches, the present invention is not limited thereto. Switch unit 27 may include touch panel-type touch switches.

Travel control levers (left and right travel control levers) 22*a* and 22*b* for the left and right crawler belts are provided on frontward side F of operator's seat 24. Left and right travel control levers 22*a* and 22*b* form a travel control unit 22 for controlling undercarriage 2.

A first control lever 44 for the operator on cab 4 to control driving of boom 6 and bucket 8 of work implement 5 is provided on right side R of operator's seat 24. A switch panel 29 having various switches and the like mounted thereon is also provided on right side R of operator's seat 24. A second control lever 45 for the operator to control driving of arm 7 of work implement 5 and revolving of upper revolving unit 3 is provided on left side L of operator's seat 24.

A monitor 21 is arranged above monitor device 26. Monitor 21 has a planar display surface 21*d*. Monitor 21 is attached to the front pillar on right side R, which is the side close to work implement 5, of the pair of front pillars. Monitor 21 is arranged in front of the front pillar in the line of sight of the operator seated on operator's seat 24 toward the frontward right direction. By attaching monitor 21 to the front pillar on right side R in hydraulic excavator 1 including work implement 5 on right side R of cab 4, the operator can view both work implement 5 and monitor 21 with a small amount of line-of-sight movement.

Figure 3:
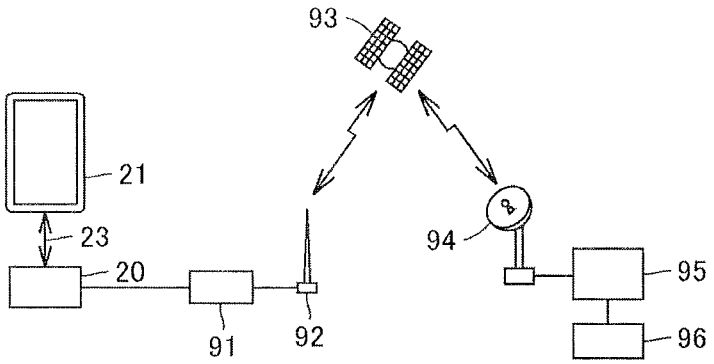
FIG. 3 is a schematic view showing a schematic configuration for transmitting and receiving information to and from the hydraulic excavator.

FIG. 3 is a schematic view showing a schematic configuration for transmitting and receiving information to and from hydraulic excavator 1. Hydraulic excavator 1 includes a controller 20. Controller 20 has a function of controlling operation of work implement 5, revolving of upper revolving unit 3, travel driving of undercarriage 2, and the like. Controller 20 and monitor 21 are connected by a bidirectional network communication cable 23 and form a communication network inside hydraulic excavator 1. Monitor 21 and controller 20 can mutually transmit and receive information via network communication cable 23. Each of monitor 21 and controller 20 is configured mainly by a computer device such as a microcomputer.

Information can be transmitted and received between controller 20 and an external monitoring station 96. In the present embodiment, controller 20 and monitoring station 96 communicate with each other by satellite communication. A communication terminal 91 having a satellite communication antenna 92 is connected to controller 20. As shown in FIG. 1, satellite communication antennas 92 are spaced apart from each other in the left-right direction and mounted on upper revolving unit 3. A network control station 95 linked by a dedicated line to a communication earth station 94 communicating with a communication satellite 93 by a dedicated communication line is connected to monitoring station 96 on the ground via the Internet and the like. As a result, data is transmitted and received between controller 20 and prescribed monitoring station 96 via communication terminal 91, communication satellite 93, communication earth station 94, and network control station 95.

Construction design data created by a three-dimensional CAD (Computer Aided Design) is prestored in controller 20. Monitor 21 updates and displays the externally-received current position of hydraulic excavator 1 on the screen in real time, such that the operator can constantly check the work state of hydraulic excavator 1.

Controller 20 compares the construction design data with the position and posture of work implement 5 in real time, and drives a hydraulic circuit based on the result of comparison, thereby controlling work implement 5. More specifically, controller 20 compares the target shape (design surface) of a work object based on the construction design data with the position of bucket 8, and executes control to prevent cutting edge 8*a* of bucket 8 from being located lower than the design surface to prevent deeper excavation than the design surface. As a result, the construction efficiency and the construction accuracy can be enhanced, and high-quality construction can be easily performed.

Figure 4:
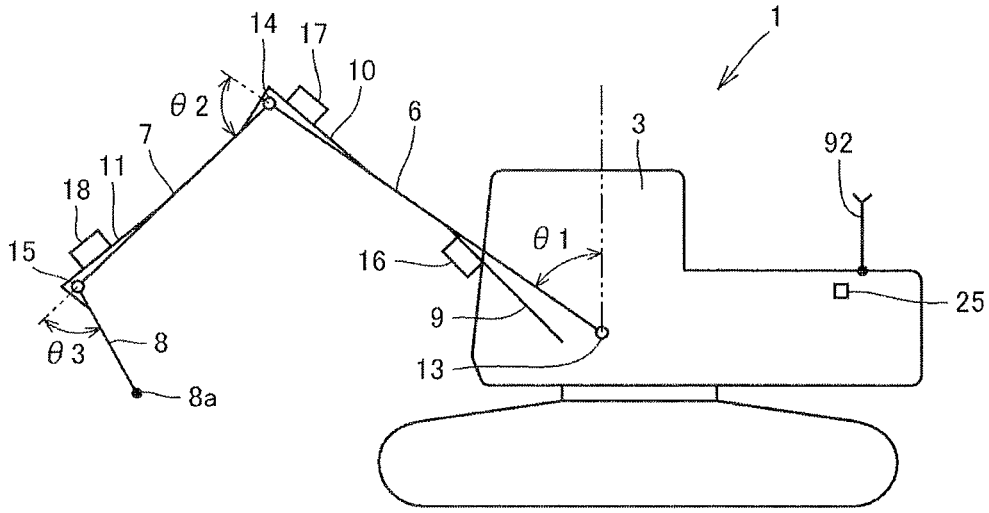
FIG. 4 is a diagram schematically showing the hydraulic excavator when viewed from the side.

FIG. 4 is a diagram schematically showing hydraulic excavator 1 when viewed from the side. As shown in FIG. 4, a proximal end of boom 6 is attached to a front part of upper revolving unit 3 by a boom pin 13. A proximal end of arm 7 is attached to the distal end of boom 6 by an arm pin 14. Bucket 8 is attached to the distal end of arm 7 by a bucket pin 15.

Boom cylinder 9, arm cylinder 10 and bucket cylinder 11 are provided with first to third stroke sensors 16 to 18, respectively. First stroke sensor 16 detects a stroke length of boom cylinder 9. Second stroke sensor 17 detects a stroke length of arm cylinder 10. Third stroke sensor 18 detects a stroke length of bucket cylinder 11. Inclination angles θ1 to θ3 shown in FIG. 4 will be described below.

A global coordinate computing device 25 is provided in upper revolving unit 3. A signal received by satellite communication antenna 92 is inputted to global coordinate computing device 25. Global coordinate computing device 25 computes a position of satellite communication antenna 92.

Figure 5:
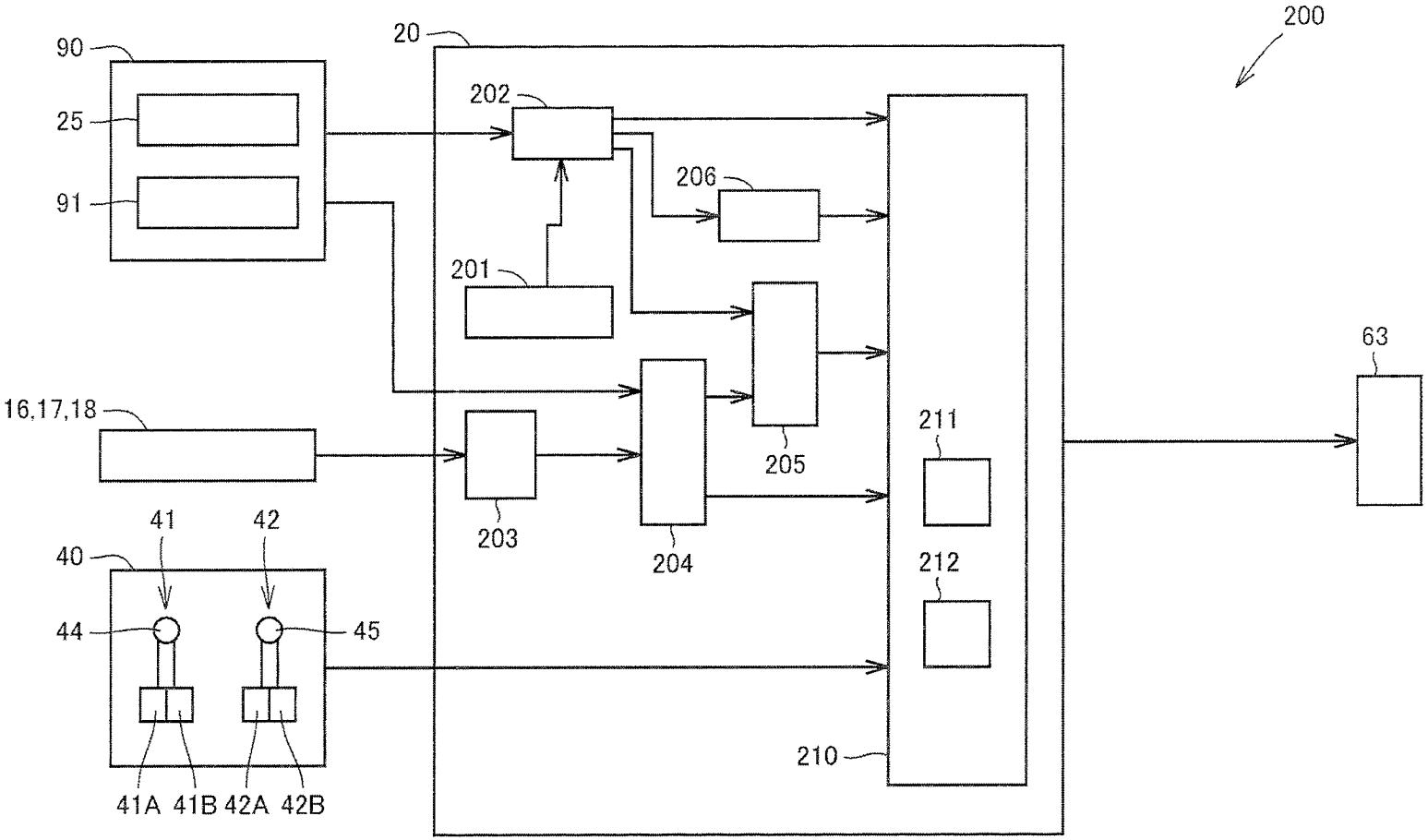
FIG. 5 is a block diagram showing a functional configuration of a control system of the hydraulic excavator.

FIG. 5 is a block diagram showing a functional configuration of a control system 200 of hydraulic excavator 1. As shown in FIG. 5, control system 200 for controlling hydraulic excavator 1 according to the present embodiment includes an operating device 40, controller 20 and an input unit 90. Input unit 90 has aforementioned global coordinate computing device 25 and communication terminal 91.

Operating device 40 accepts the operator's operation for driving work implement 5, and outputs an operation signal corresponding to the operator's operation. Operating device 40 has a first control lever device 41 and a second control lever device 42. First control lever device 41 has a first control lever 44 operated by the operator, a boom operation detecting unit 41A and a bucket operation detecting unit 41B. Second control lever device 42 has a second control lever 45 operated by the operator, a revolving operation detecting unit 42A and an arm operation detecting unit 42B.

First control lever 44 accepts the operator's operation of boom 6 and the operator's operation of bucket 8. Boom operation detecting unit 41A outputs a boom operation signal in accordance with the operation of first control lever 44. Bucket operation detecting unit 41B outputs a bucket operation signal in accordance with the operation of first control lever 44.

Second control lever 45 accepts the operator's operation for revolving upper revolving unit 3 and the operator's operation of arm 7. Revolving operation detecting unit 42A outputs a revolving operation signal in accordance with the operation of second control lever 45. Arm operation detecting unit 42B outputs an arm operation signal in accordance with the operation of second control lever 45.

Controller 20 has a storage unit 201, a design surface information acquiring unit 202, a work implement angle computing unit 203, a cutting edge position computing unit 204, a distance calculating unit 205, a design surface angle calculating unit 206, and a computing unit 210.

Storage unit 201 has various information, programs, threshold values, maps and the like stored therein. Controller 20 reads data from storage unit 201 or stores data in storage unit 201 when necessary.

Design surface information acquiring unit 202 acquires data of a design surface indicative of a three-dimensional target object of a work object by work implement 5. In the case where the data of the design surface is inputted in advance to storage unit 201 and storage unit 201 has the data of the design surface stored therein, design surface information acquiring unit 202 reads the data of the design surface from storage unit 201. Alternatively, via communication terminal 91, design surface information acquiring unit 202 may acquire, from the outside, the data of the design surface updated as needed.

Work implement angle computing unit 203 acquires data about the boom cylinder length, the arm cylinder length and the bucket cylinder length from first to third stroke sensors 16 to 18. Work implement angle computing unit 203 also calculates inclination angle θ1 of boom 6 with respect to the vertical direction in a coordinate system of the work vehicle main body, based on the boom cylinder length detected by first stroke sensor 16. Work implement angle computing unit 203 also calculates inclination angle θ2 of arm 7 with respect to boom 6, based on the arm cylinder length detected by second stroke sensor 17. Work implement angle computing unit 203 also calculates inclination angle θ3 of cutting edge 8*a* of bucket 8 with respect to arm 7, based on the bucket cylinder length detected by third stroke sensor 18.

Cutting edge position computing unit 204 acquires inclination angles θ1 to θ3 from work implement angle computing unit 203, and computes a relative position of cutting edge 8*a* of bucket 8 with respect to the work vehicle main body. Cutting edge position computing unit 204 also acquires the position of satellite communication antenna 92 from global coordinate computing device 25. Based on the position of satellite communication antenna 92 and the relative position of cutting edge 8*a* of bucket 8 with respect to the work vehicle main body, cutting edge position computing unit 204 calculates the current position of cutting edge 8*a*.

Distance calculating unit 205 acquires the current position of cutting edge 8*a* of bucket 8 from cutting edge position computing unit 204, and acquires the data of the design surface from design surface information acquiring unit 202. Distance calculating unit 205 computes a relative position of cutting edge 8*a* with respect to the design surface. More specifically, distance calculating unit 205 calculates cutting edge 8*a* being located above or below the design surface as well as a distance between the design surface and cutting edge 8*a* in the direction vertical to the design surface.

Design surface angle calculating unit 206 acquires the data of the design surface from design surface information acquiring unit 202, and calculates an inclination angle of the design surface with respect to the horizontal direction.

Computing unit 210 acquires the revolving operation signal, the boom operation signal, the arm operation signal, and the bucket operation signal from operating device 40, and outputs a control signal to a proportional solenoid valve 63 based on the information, thereby performing the operation for revolving the revolving unit and driving of work implement 5.

Proportional solenoid valve 63 is provided in a pilot circuit that connects first control lever device 41 and second control lever device 42 to a pilot switching valve for controlling supply and discharge of the hydraulic oil to and from each of boom cylinder 9, arm cylinder 10 and bucket cylinder 11. Proportional solenoid valve 63 adjusts an opening degree thereof in accordance with the control signal from controller 20. A pilot pressure corresponding to the opening degree of proportional solenoid valve 63 is applied to a pilot port of each pilot switching valve, and thereby, boom 6, arm 7 and bucket 8 are driven.

Computing unit 210 has a plurality of functional blocks representing control functions implemented by computation. Computing unit 210 has an operation restricting unit 211 and a restriction lifting unit 212.

Based on the data of the design surface acquired from design surface information acquiring unit 202 and the current position of cutting edge 8*a* acquired from cutting edge position computing unit 204, computing unit 210 computes the current positional relationship between cutting edge 8*a* and the design surface. When the operation of hydraulic excavator 1 satisfies a prescribed condition, operation restricting unit 211 instructs execution of operation restriction control.

Specifically, when an instruction for operating arm 7 is detected based on output of the arm operation signal by arm operation detecting unit 42B in the state where the distance between cutting edge 8*a* of bucket 8 and the design surface is within a reference value, operation restricting unit 211 executes the operation restriction control for forcibly raising boom 6 when it is expected that cutting edge 8*a* will invade the design surface. As a result, automatic control (profile control) for moving cutting edge 8*a* of bucket 8 along the design surface is executed.

When the operation of hydraulic excavator 1 satisfies a prescribed condition, restriction lifting unit 212 instructs operation restricting unit 211 to cancel the profile control as the operation restriction control. Specifically, when cutting edge 8*a* is located away from the design surface by a prescribed distance or longer even in the state where cutting edge 8*a* is located lower than the design surface in the perpendicular direction, the operation restriction control is canceled. As a result, in the state where cutting edge 8*a* is located away from the design surface in the downward perpendicular direction by the prescribed distance or longer, operation restricting unit 211 does not instruct execution of the operation restriction control.

When the design surface is a steep slope based on the data of the inclination angle of the design surface with respect to the horizontal direction acquired from design surface angle calculating unit 206, the operation restriction control is canceled. As a result, when the design surface is a slope inclined by a prescribed angle or larger with respect to the horizontal direction, operation restricting unit 211 does not instruct execution of the operation restriction control.

When operation restricting unit 211 does not instruct execution of the operation restriction control, computing unit 210 provides the output to proportional solenoid valve 63 without correcting the output to proportional solenoid valve 63. As a result, in accordance with the operator's operation of operating device 40, work implement 5 operates as intended by the operator.

FIG. 5 representatively shows only the functional blocks corresponding to a part of functions related to control of hydraulic excavator 1 according to the present embodiment, of the control functions implemented by control of hydraulic excavator 1 using control system 200. Each functional block shown in the figure may function as software implemented by controller 20 executing a program, while each functional block may be implemented by hardware. Such a program may be recorded on a storage medium and mounted on hydraulic excavator 1, and may be inputted to hydraulic excavator 1 via communication terminal 91.

Figure 6:
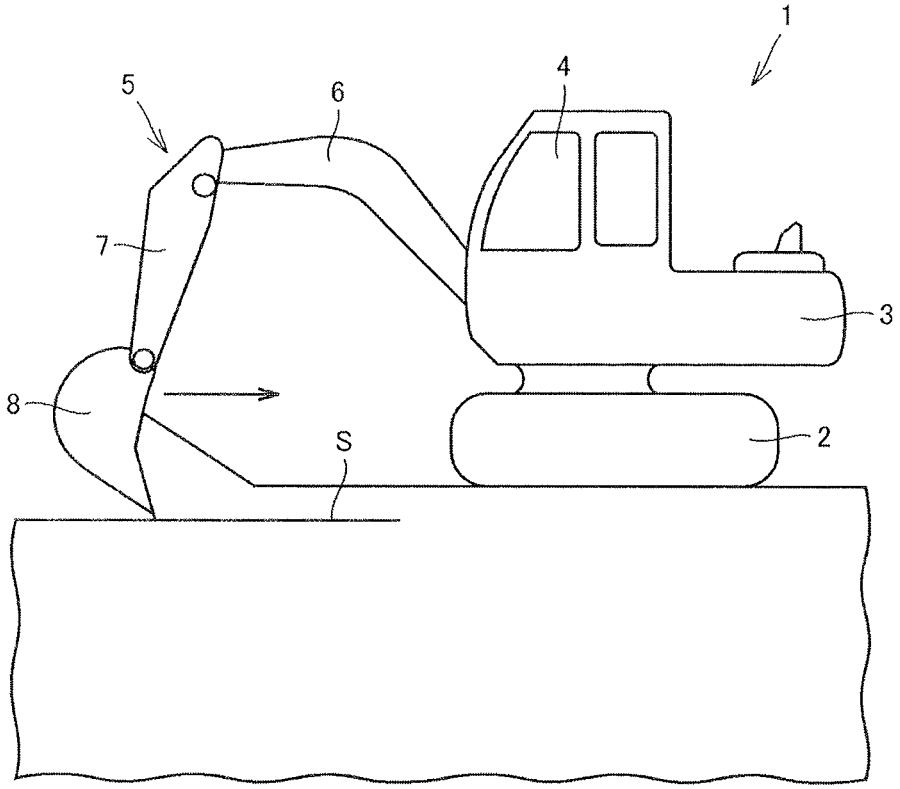
FIG. 6 is a schematic view of a land leveling work with the hydraulic excavator.

The land leveling work with hydraulic excavator 1 having the aforementioned configuration will be described below. FIG. 6 is a schematic view of the land leveling work with hydraulic excavator 1. A design surface S shown in FIG. 6 represents a target shape of a work object by work implement 5 in accordance with the construction design data prestored in storage unit 201 of controller 20 (FIG. 5). Controller 20 executes the aforementioned profile control based on the construction design data and the current positional information of work implement 5. As shown by an arrow in FIG. 6, work implement 5 is operated such that cutting edge 8*a* of bucket 8 moves along design surface S, and thereby, the ground is leveled by cutting edge 8*a* of bucket 8 and land leveling into the design landform is performed.

Cutting edge 8*a* of bucket 8 moves to follow the arc-shaped path. Therefore, when design surface S is a flat surface, cutting edge 8*a* of bucket 8 moves away from the design surface if the operation for lowering boom 6 is not performed. Therefore, in the case of performing the land leveling work with the profile control, the operator operating work implement 5 performs the operation for pulling arm 7 toward the vehicle body side, and also performs the operation for lowering boom 6.

In the case where cutting edge 8*a* of bucket 8 moves to be lower than design surface S and excavates the ground excessively when work implement 5 is operated in accordance with the aforementioned operator's operation, an instruction for forcibly raising boom 6 is outputted from controller 20. When it is expected that cutting edge 8*a* of bucket 8 will move to be lower than design surface S, controller 20 executes control for automatically raising boom 6 to prevent cutting edge 8*a* of bucket 8 from becoming lower than design surface S.

In the case where cutting edge 8*a* of bucket 8 moves away from the ground when the operation for raising boom 6 is continued, forcible raising of boom 6 is stopped and an instruction for lowering boom 6 is outputted from controller 20 in accordance with the operator's operation for lowering boom 6. As a result, the operation for lowering boom 6 is performed.

Figure 7:
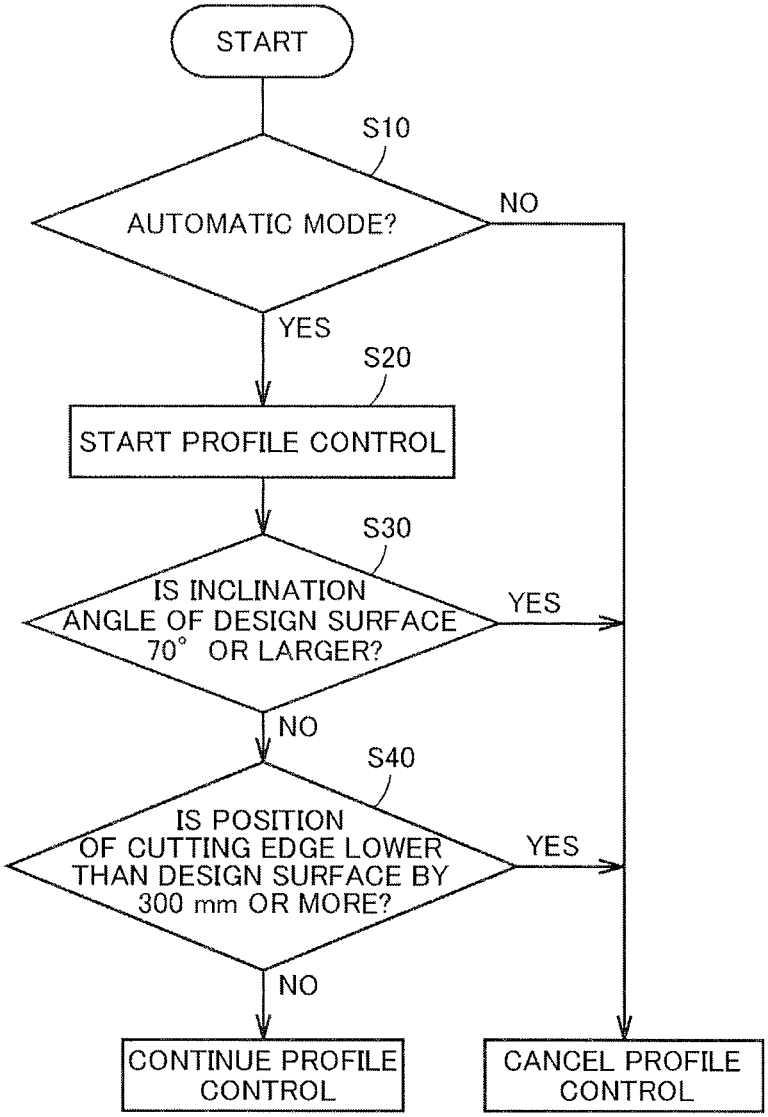
FIG. 7 is a flowchart for describing the operation of the control system of the hydraulic excavator.

FIG. 7 is a flowchart for describing the operation of control system 200 of hydraulic excavator 1. FIG. 7 shows the operation when control system 200 executes the profile control. First, in step S10, control system 200 determines whether an automatic mode, of the automatic mode and a manual mode, is selected or not. Switching between the automatic mode and the manual mode is done by the operator's operation. If the manual mode is selected (NO in step S10), work implement 5 is driven in the manual mode.

If the automatic mode is selected (YES in step S10), the process proceeds to step S20 and work implement 5 is driven with the profile control being in execution. When the instruction for operating arm 7 is detected in the state where the distance between cutting edge 8*a* of bucket 8 and the design surface is within the reference value, operation restricting unit 211 shown in FIG. 5 executes the profile control. The arm operation signal is outputted from operating device 40 to computing unit 210 shown in FIG. 5, and if computing unit 210 acquires the arm operation signal, it is determined that there is arm operation.

Next, in step S30, control system 200 determines whether or not the inclination angle of design surface S with respect to the horizontal direction is equal to or larger than a prescribed angle. Computing unit 210 shown in FIG. 5 reads a threshold value of the inclination angle of design surface S from storage unit 201, and compares this threshold value with the inclination angle of design surface S calculated by design surface angle calculating unit 206, thereby determining whether or not the inclination angle is equal to or larger than the threshold value.

As shown in FIG. 7, the threshold value of the inclination angle may be 70°. This is because the steep slope having an inclination angle larger than 70° is a cliff-like landform, and thus, the necessity for leveling the slope accurately is considered to be low.

If it is determined in step S30 that the inclination angle of design surface S is smaller than 70°, the process proceeds to step S40. In step S40, control system 200 determines whether or not cutting edge 8*a* of bucket 8 is located lower than the design surface by a prescribed distance or longer. Computing unit 210 shown in FIG. 5 acquires the data of design surface S from design surface information acquiring unit 202, and also acquires the current position of cutting edge 8*a* from cutting edge position computing unit 204. Computing unit 210 compares design surface S with the current position of cutting edge 8*a*, and calculates the distance between design surface S and cutting edge 8*a*. Furthermore, computing unit 210 reads a threshold value of the distance between design surface S and cutting edge 8*a* from storage unit 201, and compares the distance between design surface S and cutting edge 8*a* with this threshold value, thereby determining whether or not cutting edge 8*a* is located away from design surface S by the prescribed distance or longer.

As shown in FIG. 7, the threshold value of the distance between design surface S and cutting edge 8*a* may be, for example, 300 mm. This is because, if the distance is shorter than 300 mm, a movement distance of work implement 5 for moving cutting edge 8*a* to design surface S is short, and thus, the movement of work implement 5 is not sudden operation or an amount of movement of work implement 5 caused by sudden operation is reduced.

If it is determined in step S40 that the distance between design surface S and cutting edge 8*a* is shorter than 300 mm, the profile control is continued and work implement 5 is driven with the profile control being in execution. When the instruction for operating arm 7 is detected in the state where the distance between cutting edge 8*a* and design surface S is within the reference value, operation restricting unit 211 executes the profile control.

If it is determined in step S30 that the inclination angle of design surface S is equal to or larger than 70°, or if it is determined in step S40 that the distance between design surface S and cutting edge 8*a* is equal to or longer than 300 mm, the profile control is canceled. As a result, work implement 5 is driven in the manual mode. In this case, even when the instruction for operating arm 7 is detected in the state where cutting edge 8*a* of bucket 8 is located lower than design surface S in the perpendicular direction, an instruction signal for forcibly raising boom 6 is not outputted.

Next, the function and effect of the present embodiment will be described.

As shown in FIG. 5, hydraulic excavator 1 according to the present embodiment includes design surface information acquiring unit 202 for acquiring the data of design surface S, cutting edge position computing unit 204 for computing the position of cutting edge 8*a* of bucket 8, and operation restricting unit 211 for executing the operation restriction control by which boom 6 is forcibly raised in accordance with the relative position between cutting edge 8*a* of bucket 8 and design surface S, and the position of cutting edge 8*a* is restricted to an upper part of design surface S. As shown in FIG. 7, in the state where cutting edge 8*a* is located away from design surface S in the downward perpendicular direction by the prescribed distance or longer, operation restricting unit 211 executes control so as not to execute the operation restriction control.

Figure 8:
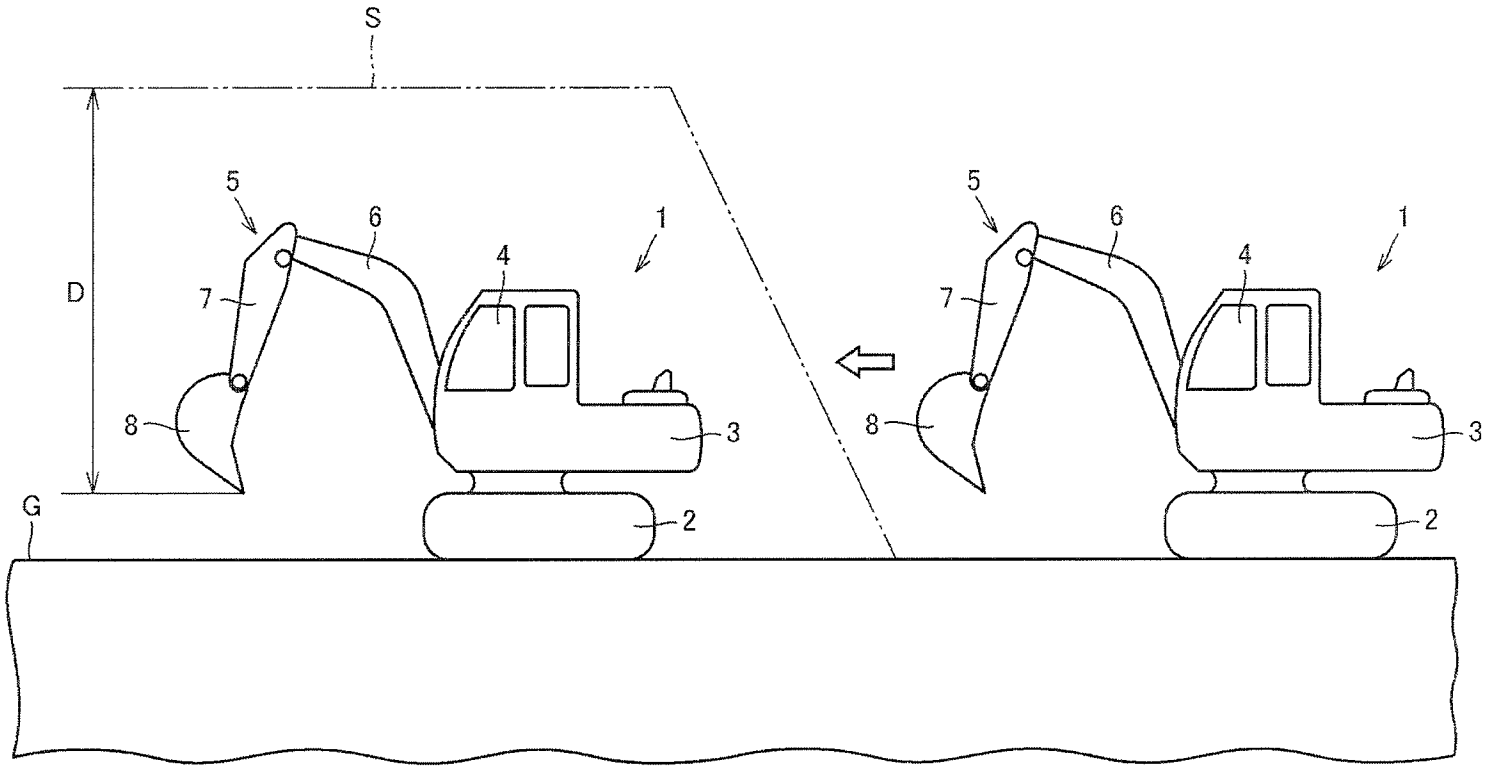
FIG. 8 is a schematic view showing one example of a positional relationship between a bucket and a design surface.

FIG. 8 is a schematic view showing one example of a positional relationship between bucket 8 and design surface S. A character "G" in FIG. 8 represents a ground of the current landform. A character "S" in FIG. 8 represents the aforementioned design surface. FIG. 8 shows the landform that will be subjected to the embankment work, and design surface S shown in FIG. 8 corresponds to an upper surface of an embankment. A character "D" in FIG. 8 represents a distance between design surface S and cutting edge 8*a* of bucket 8 in the perpendicular direction.

As shown by a hollow arrow in FIG. 8, hydraulic excavator 1 travels on ground G. Hydraulic excavator 1 travels from right to left in FIG. 8, and hydraulic excavator 1 on the left side in FIG. 8 is located within an area lower than design surface S.

In FIG. 8, while hydraulic excavator 1 is traveling, the operation of arm 7 is not performed normally, and thus, the profile control for forcibly raising the boom is not executed. Therefore, cutting edge 8*a* does not move toward design surface S, and as shown on the left side in FIG. 8, hydraulic excavator 1 enters the area lower than design surface S. When arm 7 is operated and the profile control is started in the state where bucket 8 is located lower than design surface S, boom 6 is forcibly raised suddenly until cutting edge 8*a* reaches design surface S. In this case, cutting edge 8*a* of bucket 8 moves by distance D shown in FIG. 8, and an amount of movement of work implement 5 during sudden rising is large.

By executing control so as not to execute the profile control as the operation restriction control when the instruction for operating arm 7 is detected in the state where cutting edge 8*a* is located away from design surface S in the downward perpendicular direction by the prescribed distance or longer as in the present embodiment, sudden operation of boom 6 can be prevented. Or even when work implement 5 operates suddenly, the amount of movement of the work implement can be reduced.

When design surface S is the slope inclined by the prescribed angle or larger with respect to the horizontal direction as shown in FIG. 7, operation restricting unit 211 executes control so as not to execute the operation restriction control.

Figure 9:
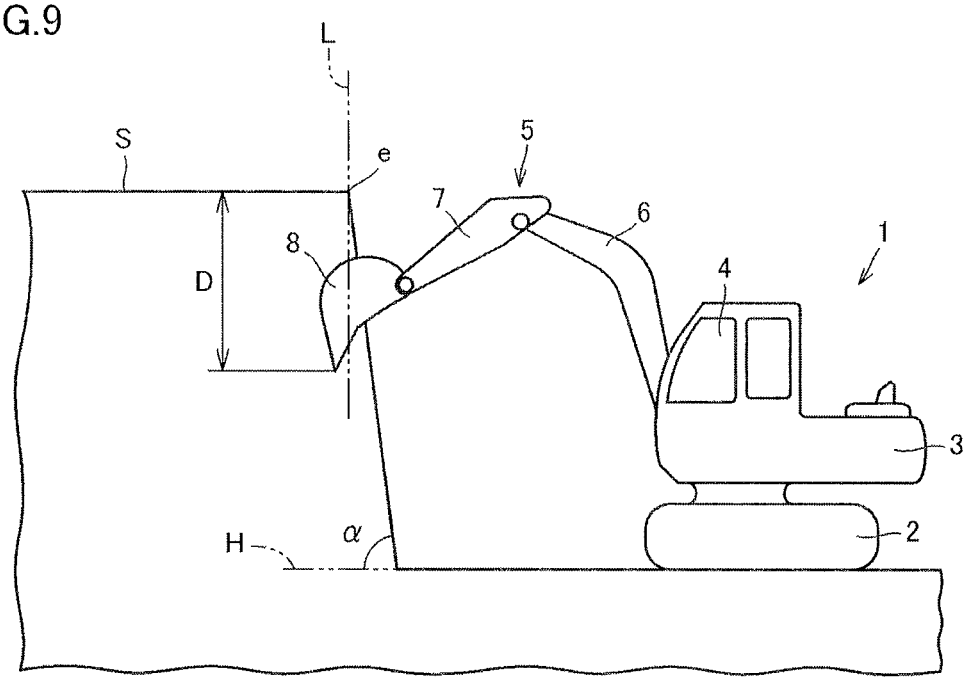
FIG. 9 is a schematic view showing another example of the positional relationship between the bucket and the design surface.

FIG. 9 is a schematic view showing another example of the positional relationship between bucket 8 and design surface S. A character "S" in FIG. 9 represents the aforementioned design surface. A character "H" in FIG. 9 represents the horizontal direction. A character "a" in FIG. 9 represents an inclination angle of a slope with respect to the horizontal direction. FIG. 9 shows a state in which work implement 5 digs in the slope during the shaping work of the slope inclined by angle $\alpha$ with respect to horizontal direction H. A character "D" in FIG. 9 represents a distance between design surface S and cutting edge 8*a* of bucket 8 in the perpendicular direction. A character "e" in FIG. 9 represents an upper end of the slope. A character "L" in FIG. 9 represents a straight line passing through upper end e of the slope and extending in the perpendicular direction.

In the case of shaping a steep slope, cutting edge 8*a* of bucket 8 easily goes beyond straight line L and cuts into the slope when work implement 5 digs in the slope as shown in FIG. 9. At this time, cutting edge 8*a* is located lower in the perpendicular direction than design surface S that is located higher than the slope. Therefore, if the profile control as the operation restriction control is executed, boom 6 is forcibly raised suddenly until cutting edge 8*a* reaches design surface S. In this case, cutting edge 8*a* of bucket 8 moves by distance D shown in FIG. 9, and an amount of movement of work implement 5 during sudden rising is large.

By executing control so as not to execute the operation restriction control when design surface S is the slope inclined by the prescribed angle or larger with respect to the horizontal direction as in the present embodiment, sudden operation of boom 6 can be prevented. Or even when work implement 5 operates suddenly, the amount of movement of the work implement can be reduced.

As shown in FIG. 6, when the instruction for operating arm 7 is detected in the state where the distance between cutting edge 8*a* and design surface S is within the reference value, operation restricting unit 211 executes the profile control. As a result, the profile control for moving cutting edge 8*a* along design surface S can be executed simply by the operation for pulling arm 7 toward the vehicle body side, and design surface S can be shaped accurately.

While the embodiment of the present invention has been described above, it should be understood that the embodiment disclosed herein is illustrative and not limitative in any respect. The scope of the present invention is defined by the terms of the claims, rather than the description above, and is intended to include any modifications within the scope and meaning equivalent to the terms of the claims.

REFERENCE SIGNS LIST

1 hydraulic excavator; 2 undercarriage; 3 upper revolving unit; 5 work implement; 6 boom; 7 arm; 8 bucket; 8*a* cutting edge; 9 boom cylinder; 10 arm cylinder; 11 bucket cylinder; 16 first stroke sensor; 17 second stroke sensor; 18 third stroke sensor; 20 controller; 40 operating device; 41 first control lever device; 41A boom operation detecting unit; 41B bucket operation detecting unit; 42 second control lever device; 42A revolving operation detecting unit; 42B arm operation detecting unit; 44 first control lever; 45 second control lever; 63 proportional solenoid valve; 90 input unit; 91 communication terminal; 200 control system; 201 storage unit; 202 design surface information acquiring unit; 203 work implement angle computing unit; 204 cutting edge position computing unit; 205 distance calculating unit; 206 design surface angle calculating unit; 210 computing unit; 211 operation restricting unit; 212 restriction lifting unit.

The invention claimed is:

1. A work vehicle, comprising:

a work implement having a boom, an arm attached to a distal end of said boom, and a bucket attached to a distal end of said arm;

a design surface information acquiring unit for acquiring data of a design surface indicative of a target shape of a work object by said work implement;

a cutting edge position computing unit for computing a position of a cutting edge of said bucket; and an operation restricting unit for forcibly raising said boom in accordance with a relative position between the position of said cutting edge of said bucket and said design surface, wherein in a state where said cutting edge is located away from said design surface in a downward perpendicular direction by a prescribed distance or longer, said operation restricting unit executes control so as not to forcibly raise said boom.

2. The work vehicle according to claim 1, wherein when said design surface is a slope inclined by a prescribed angle or larger with respect to a horizontal direction, said operation restricting unit executes control so as not to execute the forcible raising of the boom.

3. The work vehicle according to claim 2, wherein said operation restricting unit controls said boom to prevent the position of said cutting edge from becoming lower than said design surface.

4. The work vehicle according to claim 3, wherein the work vehicle transmits and receives information to and from the outside by satellite communication.

5. The work vehicle according to claim 2, wherein when the position of said cutting edge becomes lower than said design surface, said operation restricting unit forcibly raises said boom.

6. The work vehicle according to claim 5, wherein the work vehicle transmits and receives information to and from the outside by satellite communication.

7. The work vehicle according to claim 2, wherein the work vehicle transmits and receives information to and from the outside by satellite communication.

8. The work vehicle according to claim 1, wherein said operation restricting unit controls said boom to prevent the position of said cutting edge from becoming lower than said design surface.

9. The work vehicle according to claim 8, wherein the work vehicle transmits and receives information to and from the outside by satellite communication.

10. The work vehicle according to claim 1, wherein when the position of said cutting edge becomes lower than said design surface, said operation restricting unit forcibly raises said boom.

11. The work vehicle according to claim 10, wherein the work vehicle transmits and receives information to and from the outside by satellite communication.

12. The work vehicle according to claim 1, wherein the work vehicle transmits and receives information to and from the outside by satellite communication.

13. The work vehicle according to claim 1, wherein in the state where said cutting edge is located away from said design surface in the downward perpendicular direction by the prescribed distance or longer, with the forcible raising of the boom being in execution, said operation restricting unit executes control so as not to execute the forcible raising of the boom.

* * * * *